United States Patent [19]

Ito

[11] 4,168,421

[45] Sep. 18, 1979

[54] VOLTAGE COMPENSATING DRIVE CIRCUIT FOR A THERMAL PRINTER

[75] Inventor: Yoshikazu Ito, Shiojiri, Japan

[73] Assignee: Shinshu Seiki Kabushiki Kaisha, Tokyo, Japan

[21] Appl. No.: 844,957

[22] Filed: Oct. 25, 1977

[30] Foreign Application Priority Data

Oct. 25, 1976 [JP] Japan ..... 51-12799

[51] Int. Cl.[2] ..... H05B 1/00

[52] U.S. Cl. ..... 219/216; 219/543; 346/76 R

[58] Field of Search ..... 219/216, 543; 346/76 R

[56] References Cited

U.S. PATENT DOCUMENTS

| | | | |
|---|---|---|---|
| 3,467,810 | 9/1969 | Cady, Jr. | 219/216 |
| 3,913,091 | 10/1975 | Aizawa et al. | 219/216 X |
| 3,934,695 | 1/1976 | Kovalick | 219/216 X |

*Primary Examiner*—C. L. Albritton

*Attorney, Agent, or Firm*—Blum, Moscovitz, Friedman & Kaplan

[57] ABSTRACT

A voltage compensating drive circuit for a thermal printer is provided. The thermal printer includes a power supply for producing a supply voltage of varying magnitude. A plurality of exothermic printing elements are disposed on a substrate for recording print characters on a thermally sensitive medium in response to a current driving pulse being applied thereto. The printing density of the print characters, recorded on the thermally sensitive medium, are varied in response to variations in the duration of the current drive pulse applied to the exothermic printing element. The voltage compensating drive circuit is coupled to the power supply in order to detect changes in the magnitude of the supply voltage and includes an oscillator circuit for controlling the duration of the current driving pulses in response to changes in the magnitude of the supply voltage to thereby stabilize the printing density of each print character recorded on a thermally sensitive medium.

8 Claims, 8 Drawing Figures

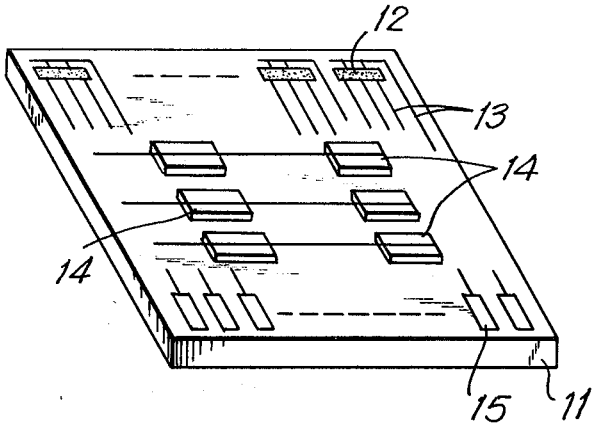
FIG. 1
PRIOR ART
FIG. 2
PRIOR ART
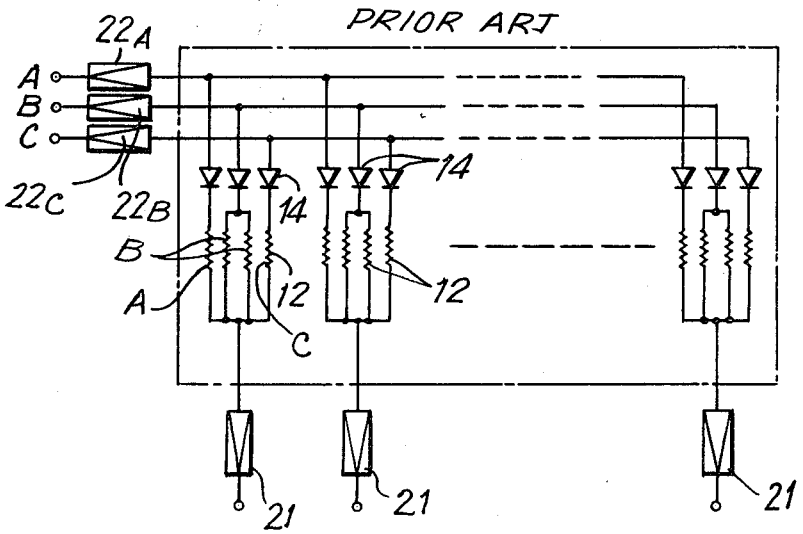

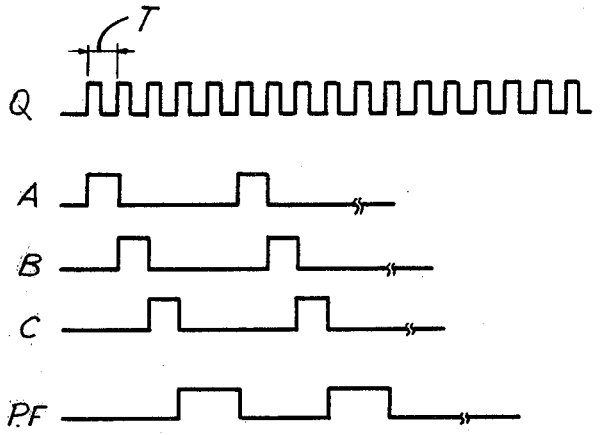
FIG. 3
FIG. 4
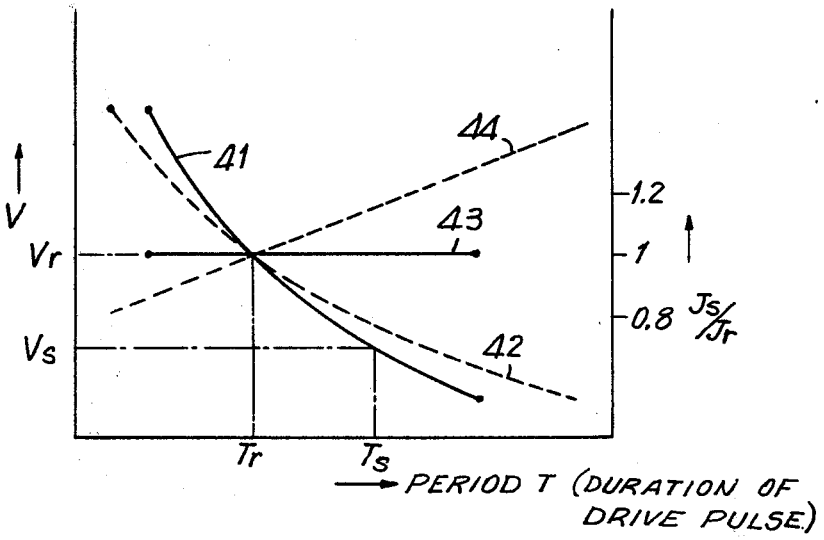

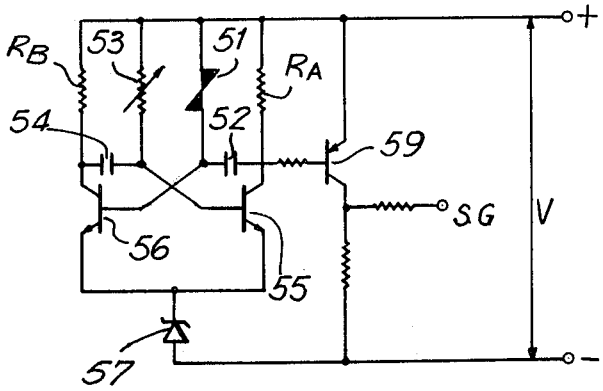
FIG. 5
FIG. 6
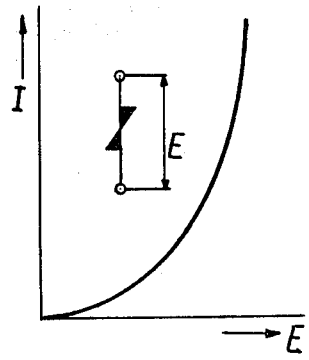

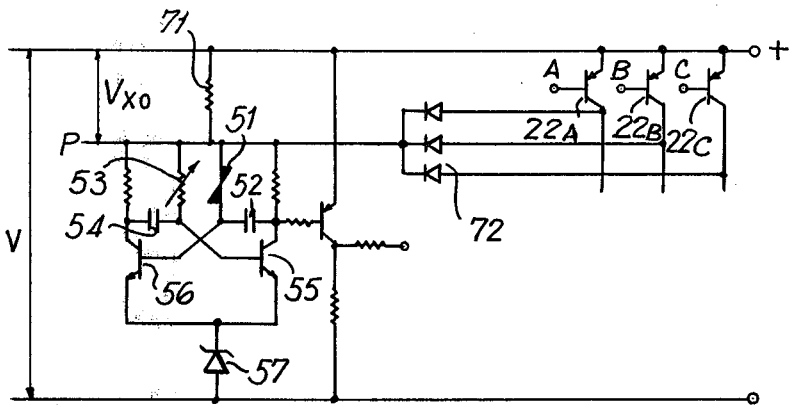
FIG.7
FIG.8
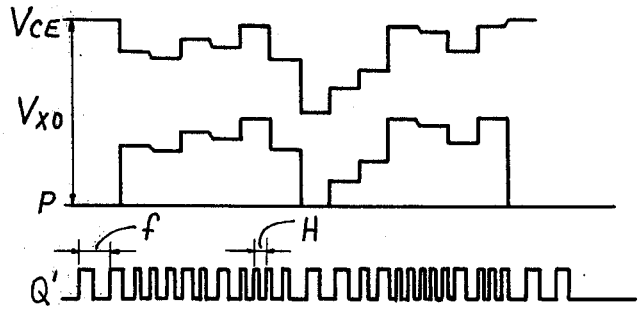

VOLTAGE COMPENSATING DRIVE CIRCUIT FOR A THERMAL PRINTER

BACKGROUND OF THE INVENTION

This invention is directed to a voltage compensating drive circuit for a thermal printer and, in particular, to a voltage compensating drive circuit for controlling the duration of current driving pulses applied to exothermic elements in response to changes in the magnitude of the supply voltage to thereby stabilize the printing density of the print characters recorded on a thermally sensitive medium.

Although thermal printers and thermal printing selection circuitry therefor have been known in the printing art for many years, thermal printers have not gained wide commercial use and acceptance. One reason for this is variations in the supply voltage that result in the print characters recorded on thermally sensitive print mediums having an unstable printing density. This is particularly the case when a limited power supply, such as a DC battery, is utilized in a small-sized thermal printer. Accordingly, a voltage compensation driving circuit that would stabilize the printing density of the print characters recorded on a thermally sensitive medium would eliminate the disadvantage noted above.

SUMMARY OF THE INVENTION

Generally speaking, in accordance with the invention, a voltage compensating drive circuit for a thermal printer is provided. The thermal printer includes a power supply for producing a supply voltage of varying magnitude. A plurality of exothermic printing elements are disposed on a substrate for recording print characters on a thermally sensitive medium in response to a current driving pulse being applied thereto. The printing density of each print character recorded on a thermally sensitive medium is normally varied in response to variations in the duration of the current drive pulses and the amplitude of the supply voltage. The instant invention is therefore characterized by a voltage compensating drive circuit coupled to the power supply for detecting changes in the magnitude of the supply voltage. The voltage compensating drive circuit includes an oscillator for controlling the duration of the current driving pulses in response to changes in the magnitude of the supply voltage to thereby stabilize the printing density of each printing character formed on the printing medium.

Accordingly, an object of the instant invention is to provide a voltage compensating driving circuit for a thermal printer that improves the printing quality of the print characters recorded on a thermally sensitive medium.

A further object of the instant invention is to provide a voltage compensating drive circuit for a thermal printer that stabilizes the printing density of the print characters, notwithstanding variations in the magnitude of the voltage produced by the power supply.

Still a further object of the instant invention is to provide a voltage compensating drive circuit for a thermal printer that reduces current consumption and, hence, reduces the rate at which a power supply, such as a battery, is dissipated.

Still another object of the instant invention is to provide an improved voltage compensating driving circuit that operates as a clocking circuit that is readily integrated into a LSI chip.

Still other objects and advantages of the invention will in part be obvious and will in part be apparent from the specification.

The invention accordingly comrpises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a thermal printing head constructed in accordance with the prior art;

FIG. 2 is a circuit diagram of a thermal printing head drive and selection circuit constructed in accordance with the prior art;

FIG. 3 is a wave diagram illustrating the operation of the thermal printing head driving and selection circuit, depicted in FIG. 2;

FIG. 4 is a graphical illustration comparing the Joule heating characteristic of an exothermic printing element and variations in the magnitude of the supply voltage with the duration of time over which the drive current is applied to the exothermic printing element;

FIG. 5 is a circuit diagram of a voltage compensating drive circuit, constructed in accordance with a first embodiment of the instant invention;

FIG. 6 is an illustrative diagram of the voltage current characteristic of the varistor depicted in FIG. 5;

FIG. 7 is a detailed circuit diagram of a voltage compensating drive circuit, constructed in accordance with a second embodiment of the instant invention; and FIG. 8 is a wave diagram illustrating the operation of the voltage compensating drive circuit depicted in FIG. 7.

DETAILED DESCRIPTION OF THE PREFERRED EMBODIMENTS

Reference is now made to FIG. 1, wherein a thermal printing head, constructed in accordance with the prior art, is depicted. The thermal printing head includes a ceramic base plate 11 supporting a plurality of exothermic resistive elements 12, which elements are adapted to thermally record print characters on a thermally sensitive medium. Drive conductors 13 are coupled to the exothermic elements and a plurality of diode chips 14 are coupled to the conductors to prevent reverse currents. Accordingly, printing is effected by feeding a thermally sensitive paper in step-wise fashion past and in contact with, or against the exothermic elements when same are selectively heated, in order to record print characters thereon.

Reference is now made to FIG. 2, wherein a thermal printing drive and selection circuit, for use with the thermal printing head depicted in FIG. 1, is provided. The exothermic resistive elements 12 are coupled in parallel with respect to each other, and are grouped to define display digits. Drivers 21 are coupled to each group of exothermic resistive elements 12 forming a digit in order to select the digit to be energized. For example, in order to energize the digit A, the driver $\mathbf{22}_A$ energizes each of the exothermic resistive elements A in each digit. If, at the same time, a digit driver 21 associated with a particular digit is energized, the resistive element A, in that particular digit, will be energized to a sufficient printing density to record a print character on a thermally sensitive medium if brought into contact with the exothermic element.

Reference is now made to FIG. 3, wherein a wave diagram, illustrating the operation of the thermal printing drive and selection circuit depicted in FIG. 2, is illustrated. The leading edge of a clock signal Q is utilized to synchronize the selection of the dots in each digit so that each digit is selected during a cycle of the clock signal Q. The signals A, B and C illustrate the sequence in which the drive current pulses are applied to the respective dots in each display digit. Additionally, a signal PF drives a step motor which advances the thermally sensitive paper after a current flow has been effected in each of the exothermic resistive elements to effect printing thereby.

The Joule heat that is generated in each exothermic resistance element of the thermal printing head is calculated by the formula:

$$J = \frac{(V - V_D - V_{CE})^2}{R} \times t$$

wherein R is the resistance value of the exothermic resistance element, V is the applied voltage, $V_D$ is the voltage drop across the diodes resulting from the diodes preventing reverse current flow and $V_{CE}$ is a voltage drop across the driver circuit during the time interval that the drive current pulse is applied to the exothermic resistance element.

As is illustrated in FIG. 4, the duration of the current driving pulse, applied to the exothermic resistance element, and the applied voltage are related to the Joule heating of the exothermic resistance element. Specifically, if the Joule heating is selected at a fixed value, as illustrated by the straight line 43, then the ratio defined by Joule heating Jr when an applied voltage $V_r$ caused a current driving pulse to be applied to an exothermic element for a duration $T_r$, to the Joule heating $J_s$ when an applied voltage $V_s$ causes a drive current pulse of a duration $T_s$ to be applied to the same exothermic element, is 1, and hence provides a constant power ratio. Curve 41 illustrates that the applied voltage is substantially reduced when the duration of the current drive pulse is increased. Alternatively, the printing density of the exothermic elements will increase when the duration of the drive current pulse is shortened and the magnitude of the applied voltage is elevated.

It is noted that the Joule heating characteristic also depends upon the heating conductivity of the materials utilized to form the thermal printing head. For example, when a ceramic printing head is utilized, the glass material has a sufficiently good conductivity to provide a fixed printing density if the characteristic of the applied voltage and duration of the current driving pulse can provide a characteristic that approaches the curve 42 in FIG. 4. When the power ratio increases is indicated by curve 44, a voltage-time duration characteristic 42 will result. Accordingly, a fixed or stable printing density cannot be obtained unless the duration of the current driving pulse is increased at the same time that the applied voltage is increased.

Reference is therefore made to FIG. 5, wherein a voltage compensating drive circuit for selectively controlling the duration of the current drive pulse, in response to detecting changes in the applied voltage, to thereby stabilize the printing density of the exothermic elements in a printing head, is depicted. As described in detail below, the voltage compensating drive circuit, depicted in FIG. 5, has a voltage-time characteristic that approximates the characteristic curve 42, illustrated in FIG. 4.

Specifically, the negative terminal (−) of a voltage supply, producing an applied voltage V, is coupled in series through a Zener diode 57 to the emitter electrodes of a pair of flip-flop transistors 55 and 56. The collector electrode of transistor 56 is coupled through a parallel connection of a biasing resistor $R_b$ and an RC circuit comprised of capacitor 54 and variable resistor 53 to the positive terminal (+) of the voltage supply. Similarly, the collector electrode of transistor 55 is coupled through the parallel connection of a biasing resistor $R_A$ and an RC circuit defined by capacitor 52 and a varistor 51 to the positive terminal (+) of the voltage supply. A gating or output transistor 59 is coupled to the flip-flop transistors and applies the clock signal produced thereby to the gating terminal SG so that a clock signal, having a frequency that is varied in response to changes in the applied voltage, is produced thereat. The base electrodes of transistors 56 and 55 are coupled intermediate the RC circuits that are common to the collector electrode of the opposite transistor, in order to assure that the flip-flop transistors 55 and 56 are oppositely turned ON and OFF. Accordingly, the transistors are alternately turned ON for a period determined by the RC circuits, after which the transistors are turned OFF, thereby determining the frequency of the clock signal and, hence, the period of the clock pulse produced at output terminal 56.

A first time constant is determined by capacitor 52 and the resistance of varistor 51 and the second time constant is determined by the variable resistor 53 and the capacitor 54. As aforenoted, the time constants, provided by both RC circuits, are utilized to control the time interval that the transistors 55 and 56 are oppositely turned ON and, hence, the duration of the current driving pulse applied to the exothermic element. In order to accommodate for variations in the supply voltage V, Zener diode 57 is disposed in series with the negative terminal (−) of the supply voltage and the switching transistors 55 and 56, in order to increase the rate of change of the applied voltage detected by the voltage compensating drive circuitry.

The current-voltage characteristic of the varistor 51 is illustrated in FIG. 6. A varistor has a current characteristic which is voltage dependent and produces a marked non-linear resistance drop as the voltage applied thereto is increased. Accordingly, by utilizing varistor 51 in the voltage compensating drive circuit, the interval T over which the drive current pulse is applied to the exothermic element will be shortened when the magnitude of the applied voltage is high, and will be lengthened when the magnitude of the applied voltage V is low. Specifically, the higher the applied voltage, the lower the resistance of the varistor 51 and, hence, the lower the time constants formed by the RC circuit comprised of varistor 51 and capacitor 52. The lower the time constants, the shorter the period of the oscillating clock signal produced by the pulse generating circuit. As illustrated in FIG. 3, the oscillating clock signal is utilized to control the duration of the drive current applied to the exothermic element of the thermal head in order to obtain a fixed or stable printing density when the amplitude of the supply voltage is varied.

It is noted, however, that when a low voltage supply such as a battery is utilized to drive the printer, the amount of current flow through the driver 22 when a single column dot is printed, is considerably different than the amount of current flow through the driver when a plurality of column dots are driven. Accordingly, a voltage compensating drive circuit, of the type depicted in FIG. 7, can be utilized to compensate for the different saturation characteristics of the driver circuit.

As illustrated in FIG. 7, the voltage compensating drive circuit, illustrated in FIG. 5, is utilized in combination with reference voltage level resistor 71 and a feedback loop for feeding back the saturation voltage of the driver circuit, like reference numerals being utilized to denote like elements depicted in FIG. 5. Reference voltage resistor 71 is disposed intermediate the variable resistor 53 and varistor 51 and the positive terminal (+) of the voltage supply for applying a reference voltage $V_{xo}$ at reference terminal P. As is explained in detail below, in an exemplary embodiment, the voltage level $V_{xo}$ is selected to approximate 1.4V. Coupling diodes 72 are utilized to feedback and detect the magnitude of the saturation voltage of the driver 22 when one or a plurality of the exothermic column dots A, B and C in each digit are energized.

As is illustrated in FIG. 8, the wave form $V_{CE}$ represents the voltage drop, or saturation voltage, of the driver and the clock signal Q' represents the variable oscillating frequency produced by the pulse generating circuit, depicted in FIG. 7. Accordingly, the clock signal Q' has a period f in the absence of a load placed on the driver, and at that time, the voltage level at the reference terminal P will be equal to the predetermined voltage level $V_{xo}$ ($\approx$1.4V). For purposes of illustration, the saturation voltage, or voltage drop, $V_{CE}$ across the driving transistors 22, depicted in FIG. 8, represent the change in the saturation voltage of the driver circuit resulting from the variable load placed on the driver circuit by the number of column dots energized. In order to simplify the illustration provided thereby, the wave diagram in FIG. 8 ignores the changes in applied voltage produced by the power source. Accordingly, the fewer the number of column dots having drive current pulses applied thereto, the larger the voltage drop across the driver and, hence, the larger the increase in the reference voltage level $V_{xo}$. When the magnitude of the supply voltage, applied to the pulse generating circuit, is elevated to a high level and the predetermined voltage level $V_{xo}$ is maintained thereat as a result of there being a small feedback voltage across the driver circuit, the frequency of the clock signal Q' is reduced to a period H that is considerably shorter than the period of the pulse f.

Accordingly, the duration of the time that the drive current pulse is applied to the exothermic element is determined by the voltage drop across the driver. Specifically, at the time when the largest load is applied to the driver as a result of few column dots being energized, the voltage compensating circuit automatically reduces the duration of the drive pulse. However, when the load across the drive circuit is reduced as a result of a large number of dots being energized, a fixed or stable printing density is obtained. Thus, the pulse generating circuit, illustrated in FIG. 7, is particularly adapted to automatically vary the oscillating frequency and, hence, the period of the clock signal produced thereby, in response to changes in the magnitude of the applied voltage and the load across the driver and thereby avoid changes in the shades of color of the print characters when same are recorded on a thermal sensitive medium at the time a severe voltage drop results from a substantial change in the number of column dots being simultaneously printed.

The instant invention provides an improved LSI clocking circuit that permits low level voltages, produced by a battery, to be utilized to drive a thermal printer. Moreover, the voltage compensating drive circuit of the instant invention permits the shade of color to be controlled in the case of single column printing and also in multiple column printing by compensating for the variation in saturation voltage of the driver circuit. The voltage compensating drive circuit of the instant invention permits the thermal printer to be mass produced and still provide high printing quality. It is further noted that the transistors utilized in the voltage compensating drive circuit can be either NPN or PNP transistors, with the polarity of the coupling diodes reversed to accommodate the particular type of transistor.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an exothermic printer including a power supply for producing a supply voltage of varying magnitude, a plurality of exothermic printing elements disposed on a substrate for recording print characters on a thermally sensitive medium in response to a current driving pulse being applied thereto, the printing density of said print characters being responsive to variations in the duration of the current drive pulses, the improvement comprising compensating drive circuit means coupled to said power supply for detecting changes in the magnitude of said supply voltage, said compensating drive circuit means including oscillator means adapted to control the duration of said current driving pulses in response to changes in magnitude of said supply voltage to thereby stabilize the printing density of said print characters recorded on a thermally sensitive medium and including exothermic drive means adapted to select said exothermic elements to be energized and apply thereto current drive pulses having a voltage sufficient to record print characters on a thermally sensitive medium and feedback means coupled intermediate said exothermic drive means and said compensating drive circuit means for detecting changes in the voltage of the current drive pulses applied to the exothermic elements and for producing a compensating signal representative thereof, said compensating drive circuit means being adapted in response to said compensating signal to control the duration of said current driving pulses applied to said exothermic elements.

2. A thermal printer as claimed in claim 1, wherein said compensating drive circuit means includes flip-flop means, said flip-flop means being adapted to produce an alternating clock signal having a variable frequency, said frequency of said clock signal controlling the duration of said current drive pulse applied to said exothermic elements.

3. A thermal printer as claimed in claim 2, wherein said compensating drive circuit means includes a variable time constant means coupled to said flip-flop means, said variable time constant means being adapted to detect changes in said applied voltage and in response thereto vary the frequency of said clock signal produced by said flip-flop means to thereby control the duration of said current driving pulse.

4. A thermal printer as claimed in claim 3, wherein said time constant means includes variable resistance means having a non-linear resistance characteristic that drops in response to an increase in the voltage level applied thereto, and thereby controls the period of the clock signal produced by said flip-flop means.

5. A thermal printer as claimed in claim 4, wherein said variable time constant means includes a capacitor series-coupled to said variable resistance means.

6. A thermal printer as claimed in claim 4, wherein said variable resistance means is a varistor.

7. A thermal printer as claimed in claim 3, and including a Zener diode disposed intermediate said voltage supply means and said flip-flop means for accelerating the variations in the supply voltage detected by said compensating drive circuit means.

8. A thermal printer as claimed in claim 3, and including reference voltage means disposed intermediate said variable time constant means and said power supply for dividing the supply voltage produced by said power supply between said reference voltage means and said variable time constant means for permitting changes in the load across said exothermic element drive means to be detected by said compensating drive circuit means in addition to the variations in the magnitude of said supply voltage for controlling the duration of said clock frequency produced by said flip-flop means.

* * * * *